United States Patent [19]

Leone

[11] 3,987,829

[45] Oct. 26, 1976

[54] CONTAINER WITH LID

[76] Inventor: Anthony J. Leone, 3301 Raleigh St. 4F, Hollywood, Fla. 33021

[22] Filed: May 5, 1975

[21] Appl. No.: 574,299

[52] U.S. Cl. ..... 150/.5; 220/72; 220/355

[51] Int. Cl.[2] ..... B65D 1/22

[58] Field of Search ..... 150/.5; 220/72, 74, 220/355

[56] References Cited

UNITED STATES PATENTS

| | | | |
|---|---|---|---|
| 2,833,324 | 5/1958 | Burroughs | 150/.5 |
| 2,873,782 | 2/1959 | Gunn | 220/72 |
| 2,984,382 | 5/1961 | Florsheim | 150/.5 |
| 3,311,257 | 3/1967 | Puente | 220/72 X |
| 3,419,184 | 12/1968 | Asenbauer | 220/355 X |
| 3,759,416 | 9/1973 | Constantine | 220/72 |
| 3,901,406 | 8/1975 | Kivett | 220/72 |

*Primary Examiner*—Donald F. Norton

[57] ABSTRACT

A lightweight shipping container of thin tough plastic material which consists of a one-piece receptacle having an open mouth bounded by an upwardly facing mouth rim surface with spaced high and low areas each having an inwardly facing abutment surface and a one-piece lid having an outer continuous peripheral downturned skirt sized to closely fit over the mouth and to receive the upwardly facing receptacle mouth rim surface within the skirt and which roof defines a peripheral pocket recess sized and arrange to register and receive the mouth of the receptacle and bear against the receptacle upon application of an inwardly directed force tending to buckle or collapse the walls.

8 Claims, 7 Drawing Figures

CONTAINER WITH LID

FIELD OF THE INVENTION

This invention relates to shipping containers, and more particularly, to a lightweight shipping container which is formed of tough, relatively pliable, thin walled plastic material and includes a receptacle and mating lid, each of a rigidifying configuration and each being companionately shaped to interlock and reinforce one another when tied together by shipping bands.

BACKGROUND OF THE INVENTION

Generally speaking it is preferable that shipping containers be relatively lightweight; and, is perhaps well known, shipping containers, particularly those used in aircraft, must be of lightweight construction. This invention is of a lightweight tough plastic container which includes a relatively thin lid configured to mate with a relatively thin walled receptacle so that the lid and receptacle coact with one another in assembly to reinforce one another when bound together by conventional shipping bands and which lid and receptacle are configured in a waffle-type rigidifying configuration.

This invention, accordingly, provides a simple and inexpensable bandable shipping container which may be of relatively thin and hence relatively pliable plastic material, so as to be light in weight but which is strong by reason of a rigidifying construction which includes mating lid and receptacle surfaces which guard against collapse of the container from inwardly and outwardly applied forces, the receptacle being configured for nesting when empty and being sufficiently strong for stacking when loaded. Generally it is, accordingly, an object of this invention to provide an improved lightweight container of plastic material adapted for shipping miscellaneous articles within the container and which may be sealed by bands to guard against pilferage.

DESCRIPTION OF PREFERRED EMBODIMENT

Figure 1:
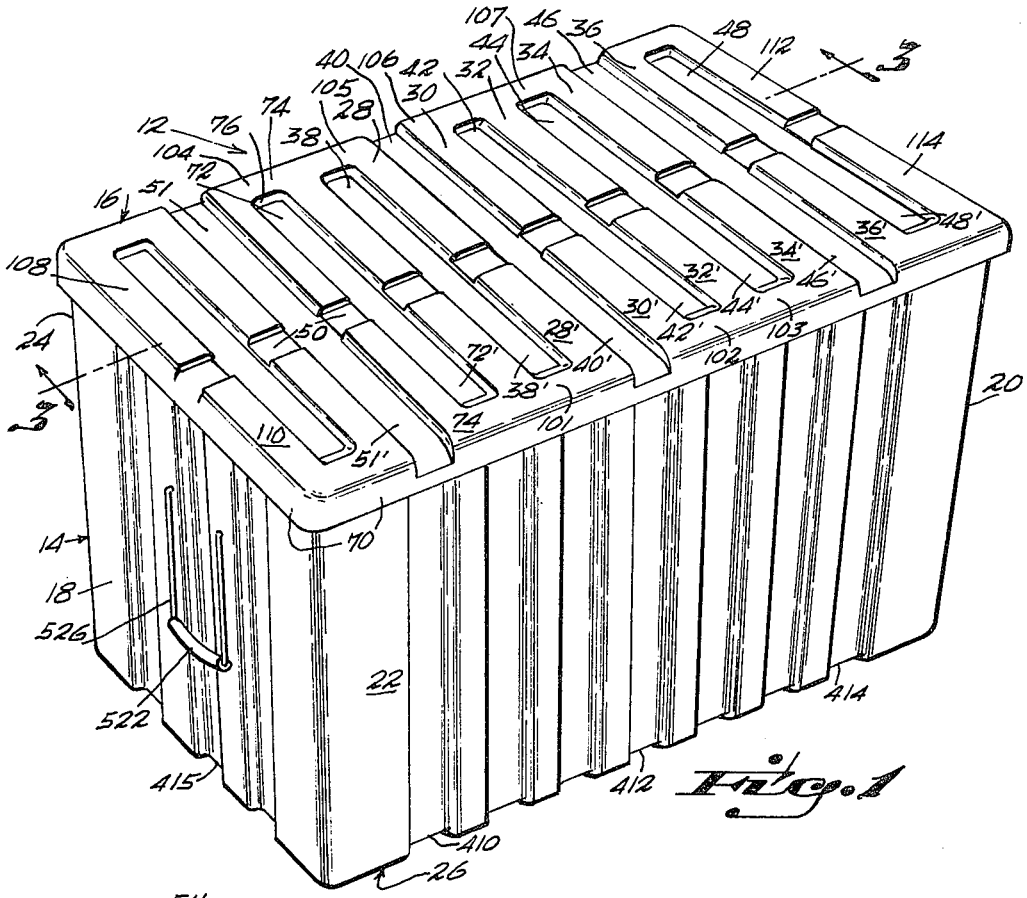
FIG. 1 is a perspective view of the instant invention.

The numeral 12 generally designates the container which includes a receptacle 14 and mating lid 16 which are preferably of a thermoplastic material, such as polyethylene.

The receptacle is composed of a one-piece structure of interconnected end and side walls 18 and 20, and 22 and 24, which are spanned at their lower ends by a bottom or floor 26. The walls and floor of the receptacle and the lid are each of a waffle-type or latticed configuration to rigidify the relatively thin walls; and each may be said to have adjacent surfaces of high and low areas, as is best understood on reference to FIG. 1. As seen in that figure, the lid, side walls and floor may be considered as being of interconnected non-planar surfaces, i.e., instead of the walls and floor being planar thin sheet form material, each are preferably of a waffle-type or latticed configuration rigidifying the structure of the container which permits the relatively thin walled construction embodiment.

For example, the lid 16 includes the high areas, such as 28, 30, 32, 34 and 36 and 28′, 30′, 32′, 34′ and 36′ and each has adjacent lower areas 38, 40, 42, 44, 46, 48 and 50 and 38′, 40′, 42′, 44′, 46′ and 48′. The main or central zone of the lid structure is ribbed or rigidified in this configured manner; the rigidifying means permitting a thin wall structure of tough plastic material which, but for the rigidifying ribbed configuration, would be quite pliable.

Figure 3:
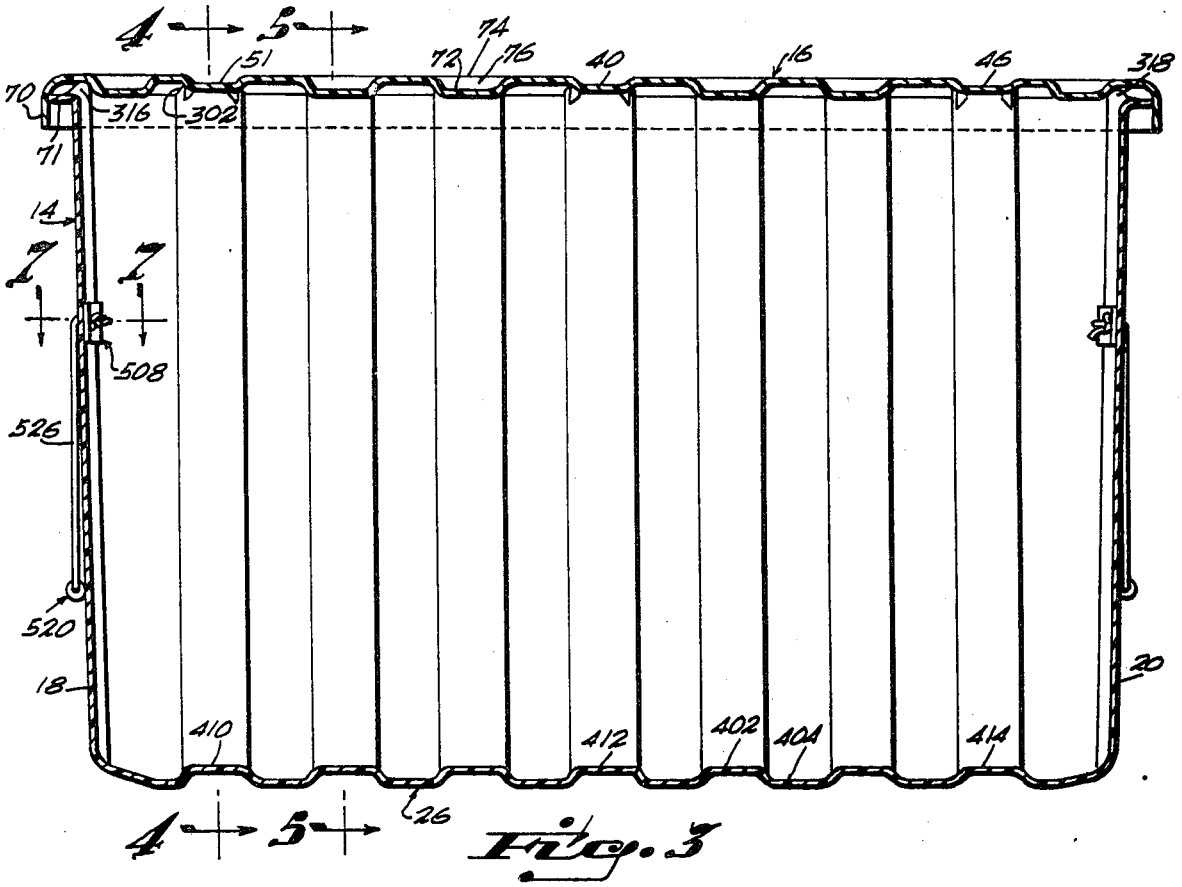
FIG. 3 is a view in cross section taken on the plane indicated by the line 3—3 of FIG. 1.
Figure 4:
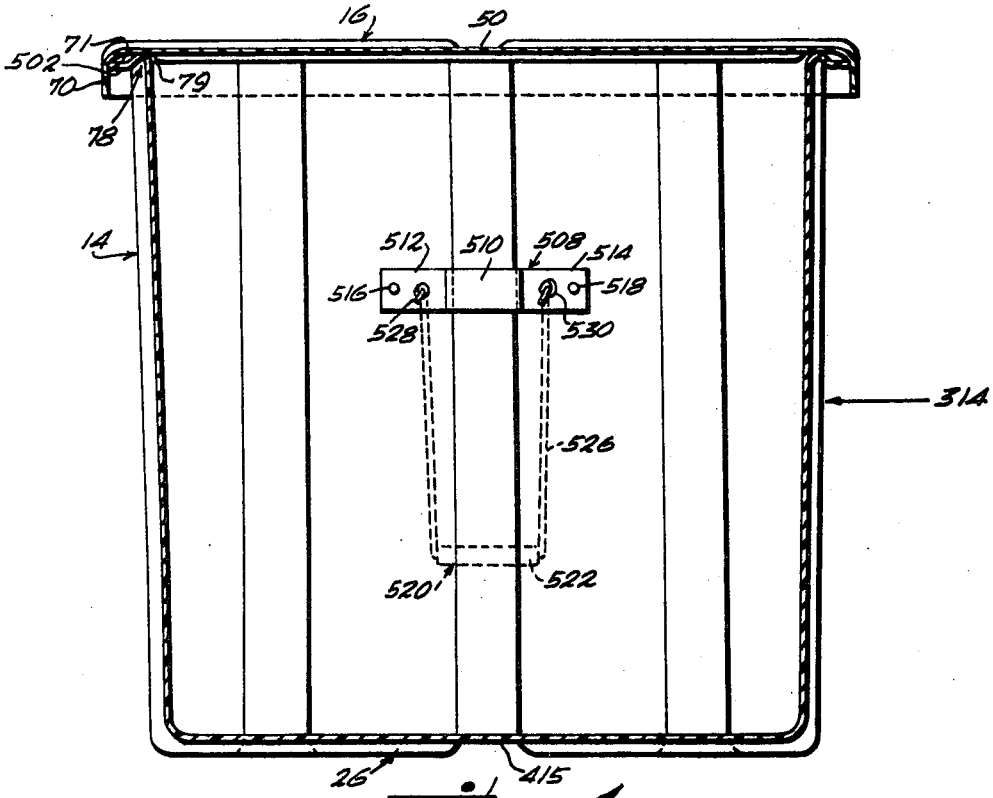
FIG. 4 is a view in cross section taken on the plane indicated by the line 4—4 of FIG. 3 and looking in the direction of the arrows.
Figure 5:
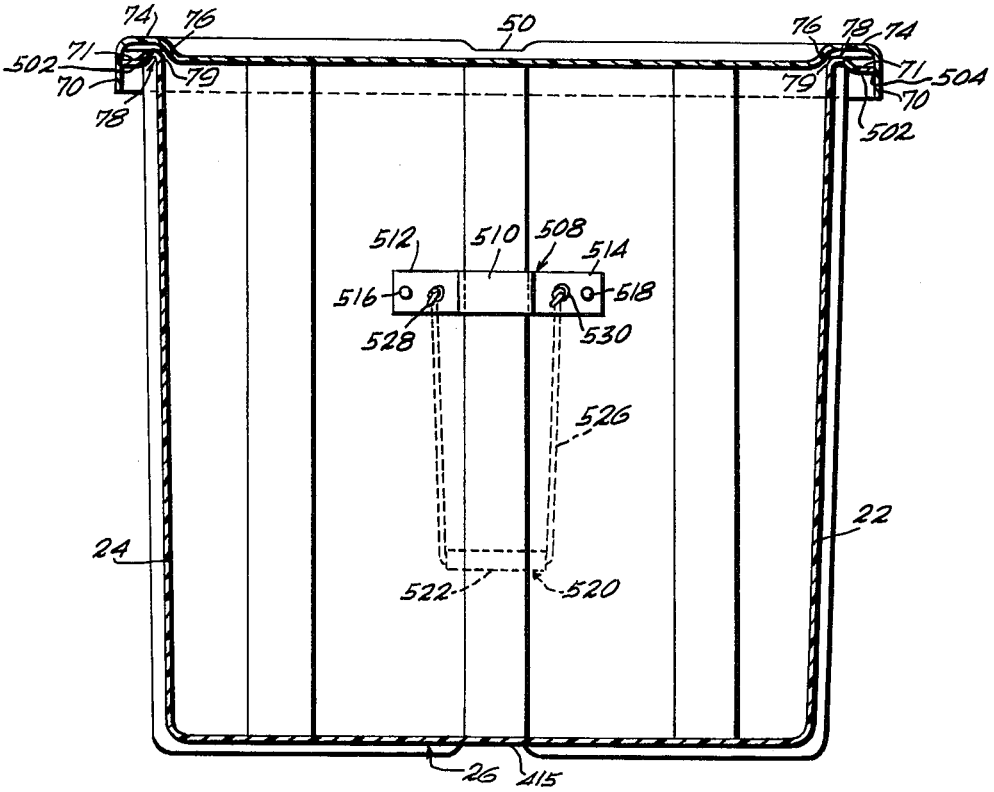
FIG. 5 is a view in cross section taken on the plane indicated by the line 5—5 of FIG. 3.

With continued reference to the lid, it includes a peripheral downturned flange or skirt 70 which, as seen in FIGS. 3, 4 and 5, is sized to nest snugly over the receptacle mouth which is bounded by the upper end surface 71 of the side and end walls. The skirt captivates the upper end zone of the wall to resist outwardly directed forces when the receptacle is full, i.e., under a load.

Also, as seen in FIGS. 3, 4 and 5, the low areas of the lid, such as 72, do not extend to the edge of the skirt, but, rather terminate at a web or septem means 76, which connects the plane of the low areas 72 to that of the adjacent peripheral high area 74. Such a web or septum means is also characteristic of the peripheral end of the other low areas, such as 72′; 38, 38′; 42, 42′; and 44, 44′. There is thus formed a peripheral recess, pocket or nest between the web or septum means 76 and the skirt 70 beneath the high peripheral zone 74, which pocket opens downwardly and extends upwardly to the plane of the high area 74. The peripheral recess, pocket or nest is preferably continuous between the septum webs, such as 76 and the skirt, such as at 101, 102, 103, 104, 105, 106, 107, 108, 110, 112, and 114.

Within the pocket the upper end of the receptacle walls are received and an inwardly directed force on the walls causes the upper end zone to bear against the web septums to resist inward buckling. Preferably the upwardly facing mouth rim surface of the walls include elevated portions or beads to be received in the peripheral lid recess, as will be described hereinafter.

Figure 6:
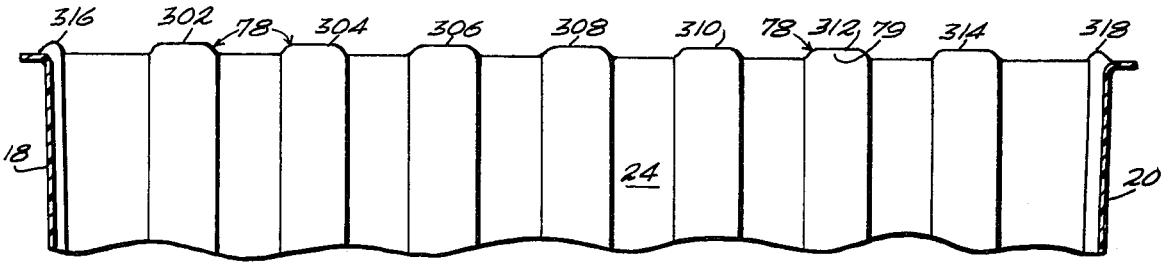
FIG. 6 is a view of the upper end zone which is partly in cross section taken on the plane indicated by the line 3—3 of FIG. 1.
Figure 7:
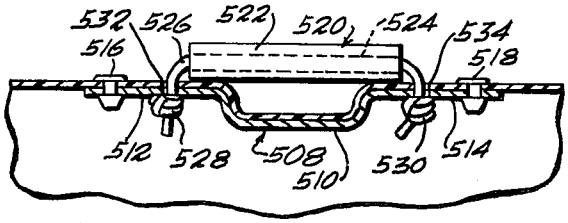
FIG. 7 is a view in cross section taken on the plane indicated by the line 7—7 in FIG. 3, the lid being removed.

Thus, when the lid is held tightly to the receptacle, as by the shipping bands 206, 208, 210 (shown in dotted lines in FIG. 2) the peripheral recess receives the upwardly extending elevated portions or beads 78 of the top rim surface of the walls. An inwardly directed force applied externally of the receptacle upon the walls causes the elevated portions or beads, captivated in the peripheral recess or pocket, to bear against the septum or webs of the lid which connect the high and low areas and by so doing restrain the walls from collapse or buckling. The walls, it is seen in FIG. 1, are also of a ribbed construction which may be described as being composed of an inner and outer vertically extending wall portion interconnected by return wall segments. In other words, the walls as viewed in a medial plan view and seen in cross section might be said to be generally corrugated throughout their respective lengths, between the upper surface 71 and the floor. The wall portions terminate at the upper surface 71, which bounds the mouth or opening of the receptacle, but which upper wall surface is preferably not planar. The upper wall surface about the mouth of the receptacle in the preferred embodiment illustrated has high and low areas, see FIGS. 3 and 6, in which the elevated portions or peripheral bumps or beads comprise the upper terminal ends of the inner wall portions and return wall segments. The beads are of generally inverted downwardly outwardly tapered dome-shaped structure interconnecting the inner side wall portions and the return wall segments; and those on the side walls are designated by the numerals 302, 304, 306, 308, 310, 312, and 314; and those of the end walls are designated by the numerals 316 and 318, it being understood, as shown in FIG. 1, that there are three in each end wall.

Figure 2:
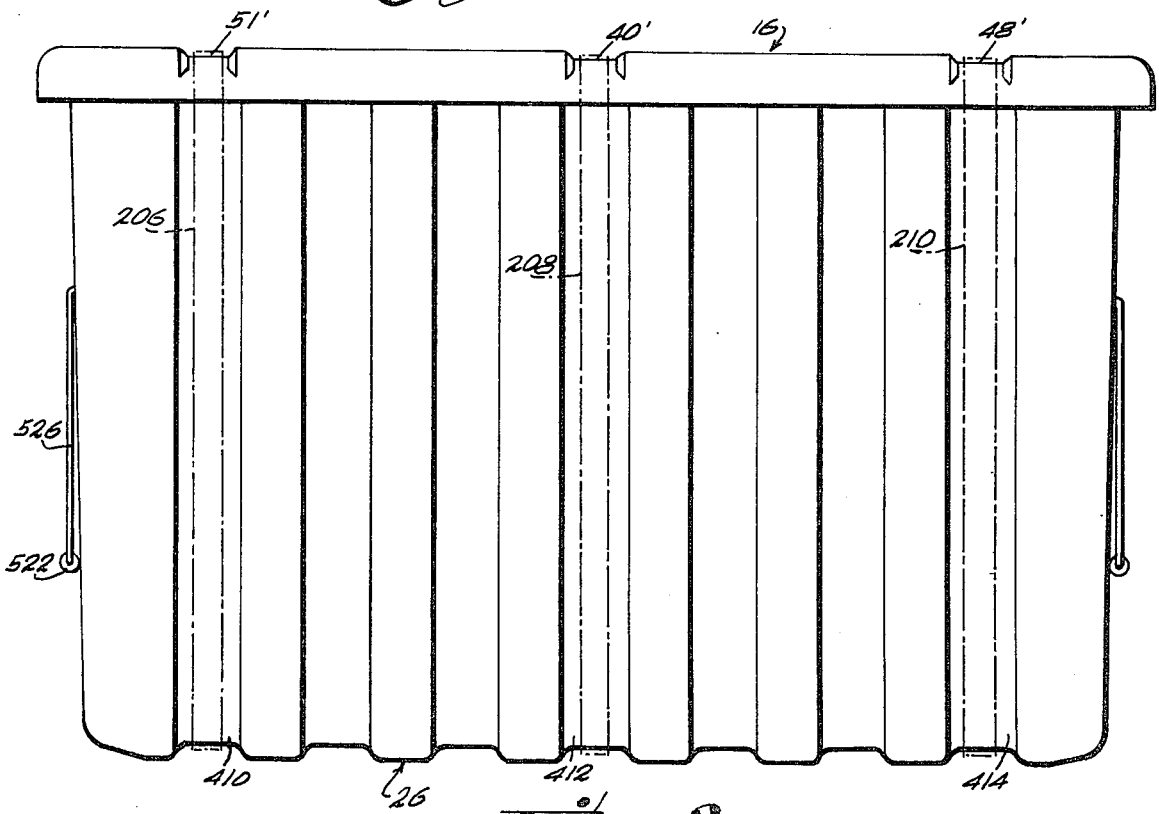
FIG. 2 is a side elevation view of the container of FIG. 1.

In the preferred embodiment illustrated, each of the wall portions, such as 312, terminate in an upwardly projecting portion or bead 78 presenting an inner face as at 79 to the confronting inside surface of the septum or web 76, which is part of the inner wall of the peripheral recess of the lid, so that the surfaces 76 and 78 abut one another and guard against collapse of the walls upon application of an inwardly directed force as indicated by the arrowed line 314, when the lid is in the position shown in FIG. 1 and tightly held in place by the shipping bands, as shown by the dotted lines in FIG. 2.

The floor of the receptacle is also defined by a surface having adjacent high and low areas, such as 402 and 404, see FIG. 5, which merge and blend with corresponding inner and outer rib areas of the side walls.

In the preferred embodiment illustrated, the walls are uniformly tapered inwardly and downwardly from the mouth of the receptacle or upper wall surface so that similar size receptacles are adapted to be nested when empty. With respect to the floor, it is also of a waffle-type or ribbed construction and, in the preferred embodiment, see FIG. 2, spaced lateral high areas of the floor ribs 410, 412, and 414 and a longitudinally extending high area 415, see FIG. 4, extend all the way between opposite walls. The inner areas of the ribs of the walls provide shipping band grooves for shipping bands 206, 208 and 210, which hold the lid in closing relation of the receptacle, see FIG. 2. Also the bands are protectively within the recesses or grooves 410, 412, 414 and 415 so as not to contact the surface on which the container rests when loaded or which it is dragged in use.

The lid is also provided with band grooves which will now be described. The plane of the lower areas 46 and 46', 40 and 40', and 50, as seen in FIG. 1, as well as 51 and 51' are preferably coplanar and lie between the level of the high and low areas of the lid. The band seats in the groove thus formed. The grooves do not terminate at a web 76 but, rather, extend all the way to the skirt, merging and blending with the skirt surface in a fair curved downwardly directed recessed surface. It is thus seen that the band grooves prohibit lateral movement of the shipping bands once in position; and the tension of the bands holds the upward projections or beads of the walls in the peripheral pocket so that the lid and receptacle coact reinforcing one another. When the bands are tight the floor of the band grooves, as at 51 bears against the top of the bead 78.

The skirt of the lid is continuous and sized to snugly receive the upper surface of the walls. The lid roof is configured preferably with the central waffle surface which has the above-mentioned three levels: the intermediate level defining the floor of the shipping band grooves, and the high and low areas comprising a pattern in relief which defines the septum means for the inner side of the peripheral pocket or recess described above. The pattern in relief includes opposed generally U-shaped high areas as seen in plan, and also in FIG. 1, with one side of the base of each U-shaped area merging and blending with the skirt surface and the other side of the base of the u-shaped high area, that is between the legs of the U-shaped configuration, merging and blending with the low area between the legs of each U-shaped high area, and in so doing form the wall of the peripheral recess of the lid. Within the U-shaped portion an additional high area may be provided, as shown in the drawings; and, in any event, the waffle-type configuration of the lid rigidifies it. Generally, the wall or septum of the inside surface of the U-shaped raised portion which connects the lower area is parallel to and spaced from the skirt providing an abutment surface to abut the inwardly facing surface of the upper end of the walls, which are preferably provided with beaded or elevated portions on the top of the inner wall portion of the side and end walls.

As shown in the drawings, the upper surface of the walls preferably is provided with an outturned peripheral flange 502, the edge 504 of which is well within the skirt in assembly as seen in FIG. 5 and together with the skirt provides a weather-proof labyrinth type seal. Handles may be provided, such as that shown for the end walls. For this purpose a bracket 508 preferably of metal is secured inside the receptacle. The bracket includes a U-shaped portion 510 to embrace the inner surface of the central inner wall portion or rib and includes flange portions 512 and 514 which overlay the adjacent outer wall portions. It is fixed to the receptacle by the rivets 516 and 518. The handle 520 includes a roller 522 with a through bore 524 through which a string 526 is passed which is knotted at the respective ends 528 and 530 after being passed through holes 532 and 534 in the flanges of the brackets respectively.

When several containers similar to that described above are stacked in a loaded condition, one upon the other, it is seen that the downwardly directed forces are transmitted from the bottom of the upper wall container through the lid and beads and down the wall segments which connects the adjacent inner and outer wall portions and this generally Z-shaped zone as seen in cross section comprises a load bearing column. It is thus seen that there has been provided a simple and inexpensive construction of a lightweight plastic material in the form of a container which includes a receptacle and a lid which are companionately configured to mate and provide a strong lightweight shipping container the surfaces of which coact to resist inward buckling by an external force applied to the side walls and outer buckling by reason of a load and which is generally configured in a ribbed or waffle-type configuration to rigidify the same.

In a preferred embodiment the wall thickness is uniform and may be 3/16 inch when polyethylene is used with the top flange extending outwardly from the inner surface of the inner wall portions about ½ inch. The wall portions are about 2 inches across and of an overall heighth of about 26 inches. The wall segments joining the wall portions are about 3/16 inch. The length of the side walls are about 42 inches and the end walls about 29 inches. The depth of the septum means, that is the inner wall of the peripheral recess or pocket of the lid, is about ½ to ¾ inch and may be tapered downwardly and inwardly as shown. This depth is less than the downwardly extension of the skirt and sized to coact with the upper end zones of the walls to resist against inward buckling.

What is claimed is:

1. A plastic container comprising:

A. a one-piece lid having a. a roof with an elevated peripheral zone having an outer margin, b. a continuous downturned skirt extending downwardly from the outer margin of the peripheral zone, said skirt having an inner and outer side and end faces, and c. said roof having downwardly extending septum means spaced inwardly from the inner surface of said skirt, defining a downwardly opening peripheral recess between the septum means, elevated peripheral zone and the skirt; and B. a one-piece receptacle having a. side walls and end walls spanned by a floor, b. said walls having an inner face and an outer face and terminating at a rim surface, c. the inner and outer faces of said walls at said rim surface comprising an abutment zone, d. said rim surface being sized for receipt within said downwardly opening peripheral recess with said septum means and inner face of said skirt closely adjacent said abutment zone;

e. a central roof zone including a central shipping band groove extending completely across the roof from end face to end face and spaced lateral band grooves extending completely across the roof from side face to side face and the floor of said grooves being of a depth less than that of said septum means from said elevated peripheral zone.

2. A plastic container comprising:

A. a one-piece lid having a. a roof with an elevated peripheral zone having an outer margin, b. a continuous downturned skirt extending downwardly from the outer margin of the peripheral zone, said skirt having an inner and outer side and end faces, and c. said roof having downwardly extending septum means spaced inwardly from the inner surface of said skirt, defining a downwardly opening peripheral recess between the septum means, elevated peripheral zone and the skirt; and B. a one-piece receptacle having a. side walls and end walls spanned by a floor, b. said walls having an inner face and an outer face and terminating at a rim surface, c. the inner and outer faces of said walls at said rim surface comprising an abutment zone, d. said rim surface being sized for receipt within said downwardly opening peripheral recess with said septum means and inner face of said skirt closely adjacent said abutment zone;

e. the walls of said receptacle include adjacent inner and outer wall portions defining a ribbed configuration wherein each of said wall portions are joined to adjacent wall portions by a return wall segment, each of said outer wall portions terminating at a common heighth and each of said inner wall portions and wall segments terminating at a common heighth which is greater than the common heighth of said outer wall portions said inner wall portions and segments being spanned by a dome-shaped structure comprising an abutment bead and the inner faces of said beads comprising said abutment zone.

3. The container as set forth in claim 2 wherein the rim surface includes an outturned flange and the outer edge of said flange comprises an abutment zone.

4. The container as set forth in claim 2 wherein the dome shaped structure has an upper domed zone and downwardly tapered sides and ends defining a recessed zone beneath the dome structure, said inner and outer wall portions having parallel vertical zones of adjoinment with the adjacent wall segments.

5. The container as set forth in claim 4 wherein the floor of the receptacle includes adjacent upper and lower portions defining a ribbed configuration.

6. The container as set forth in claim 2 wherein the floor of the receptacle includes adjacent upper and lower portions defining a ribbed configuration.

7. The container as set forth in claim 2 wherein the floor of the receptacle includes adjacent upper and lower portions defining a ribbed configuration.

8. The container as set forth in claim 7 wherein grooves are provided, said grooves being aligned with opposed inner wall portions and the upper portion to recess a shipping band when tightly secured therein to hold the lid to the receptacle.

* * * * *